US006588030B1

(12) United States Patent
Wulff

(10) Patent No.: US 6,588,030 B1
(45) Date of Patent: Jul. 8, 2003

(54) SOAP AND ACCESSORY SUPPORT

(76) Inventor: Alan T. Wulff, 27985 Flower Valley Rd., Red Wing, MN (US) 55066

( * ) Notice: Subject to any disclaimer, the term of this patent is extended or adjusted under 35 U.S.C. 154(b) by 0 days.

(21) Appl. No.: 10/273,886

(22) Filed: Oct. 21, 2002

(51) Int. Cl.[7] ..... A47K 3/22

(52) U.S. Cl. ..... 4/605; 4/559; 211/90.01; 211/119.009; 108/25; 206/77.1; D6/532; D6/525

(58) Field of Search ..... 4/605, 559, 571.1, 4/574.1, 573.1; 211/88.01, 87.01, 90.01, 86.01, 119.009, 126.1, 126.5, 134; 108/152, 50.1, 24, 25; 206/77.1; 312/229, 228; 248/220.1; D6/529, 527, 525, 524, 532, 536

(56) References Cited

U.S. PATENT DOCUMENTS

| | | | | | |
|---|---|---|---|---|---|
| 1,088,783 | A | * | 3/1914 | Lisbae | 211/90.04 |
| 2,450,305 | A | * | 9/1948 | Shoemaker | 62/286 |
| 2,522,442 | A | | 9/1950 | Garris | |
| D162,981 | S | | 4/1951 | Olson | |
| D175,229 | S | | 7/1955 | Neufeld | |
| 2,911,108 | A | * | 11/1959 | Nield | 108/152 |
| D206,257 | S | * | 11/1966 | Maurus | D32/55 |
| D266,808 | S | | 11/1982 | Thompson | |
| D267,059 | S | | 11/1982 | Thompson | |
| 4,392,630 | A | * | 7/1983 | Moontasir | 248/316.8 |
| 4,708,310 | A | | 11/1987 | Smith | |
| D307,222 | S | | 4/1990 | Korpijaako et al. | |
| D329,562 | S | * | 9/1992 | McKeone et al. | D6/531 |
| 5,181,606 | A | * | 1/1993 | Martell | 206/77.1 |
| D335,598 | S | | 5/1993 | Kerbs | |
| 5,242,064 | A | * | 9/1993 | Martell | 211/85.13 |
| D364,767 | S | | 12/1995 | McLinden | |
| D371,831 | S | | 7/1996 | Suarez | |
| D386,639 | S | * | 11/1997 | Everett | D6/525 |
| D390,399 | S | | 2/1998 | Camilo | |
| D391,106 | S | | 2/1998 | Camilo | |
| D395,186 | S | | 6/1998 | Pollack | |
| 5,992,654 | A | | 11/1999 | Dente, Jr. | |
| 6,052,845 | A | | 4/2000 | Harvey | |
| D451,743 | S | | 12/2001 | Henderson et al. | |

* cited by examiner

*Primary Examiner*—Gregory Huson
*Assistant Examiner*—Huyen Le
(74) *Attorney, Agent, or Firm*—Dowell & Dowell, P.C.

(57) ABSTRACT

A shelf or support caddy for a bathroom shower or tub enclosure which includes a body having at least one recessed soap tray integrally formed therein which tapers toward a forward drainage slot formed in a front edge of the body and which slot is tapered to grip a string or handle element of a bathing accessory.

14 Claims, 2 Drawing Sheets

SOAP AND ACCESSORY SUPPORT

BACKGROUND OF THE INVENTION

1. Field of the Invention

This invention is generally directed to article supports which are particularly adapted for use in bathroom tub and shower enclosures and more specifically to a shelf or caddy which is designed to be mounted into a tile wall at a corner of a tub or shower enclosure and which is used to support soap, shampoo and other containers and bathing accessories.

2. Brief Discussion of the Related Art

Different styles of shelves and article support caddies have been designed for specific use in bathtub and shower areas. Many of these provide support for a variety of shampoos, rinses, conditioners, soaps and other accessories used during bathing.

One problem inherent with a number of such shelves and caddies is that they are difficult to install, especially in-tiled shower or tub enclosures. Many such shelves or caddies are thus often designed to be simply mounted on the surface of a preexisting tile enclosure and do not look finished when installed. In instances where a shelf or caddy is to be installed during the tiling of a wall, the cutting of tile around the shelf or caddy is necessary to provide a finished appearance.

A further problem inherent with many conventional shelves used in tub and shower enclosures is that when wet soap is placed on a support surfaces, water will either collect or will drip or drain from the surface onto the floor or sidewalls of the shower or tub enclosure which can create not only an unsightly appearance but can also create a safety hazard by creating a slippery surface in the enclosure.

By way of example, in US Design Patents Des 364,767 to McLinden and Des 335,598 to Kerbs, shower caddies or soap and article holders for use in showers are shown. In each, a recessed area is provided for supporting soap. To prevent build-up of a soap liquid within the recessed areas, slits are provided in the sidewall of the supports for allowing drainage. However, the drainage of the liquid soap within such recessed areas will flow directly onto the floor or sidewalls of the tub or shower enclosure, thereby creating a further problem.

In view of the foregoing, there remains a need to provide for a shelf or caddy which can be used in a tub or shower enclosure and which may be installed in an efficient and finished manner and which also provides structure for supporting articles used in a bathroom shower or tub enclosure in such a way as to limit the possible seepage or spillage of soap from such supports onto sidewalls or floor of the tub or shower.

SUMMARY OF THE INVENTION

The present invention is directed to a soap and shampoo caddy or support shelf which is specifically designed to be mounted within a corner of a tub or shower enclosure and preferably within such an enclosure having tiled or similar type masonry walls. In a preferred embodiment, the caddy or shelf is somewhat "L" shaped in configuration having a first section extending outwardly from an innermost corner of the shelf in a first direction which is generally perpendicular to a second section which also extends outwardly from the innermost corner of the shelf. The outer ends of each of the extended sections include a cut-away portion generally of a size to allow a conventional wall tile to be inserted between the wall and an inner edge of the shelf or caddy.

The invention further provides at least one soap supporting recessed area or tray which is tapered downwardly from adjacent a rear portion thereof to a front portion thereof. Further, a relief cut or tapered notch is provided through the front edge of the shelf so as to communicate with the forward or front portion of the recessed soap supporting area. In this manner, when soap is placed in the recessed area, any liquid on the soap is allowed to drain toward the front of the recessed area and through the tapered slot. The slot is designed to provide opposed gripping surfaces in which a string or handle of a shower or bath tub accessory, such as a scrubby or sponge, may be inserted so that the scrubbing head of the accessory depends directly below the slot so that any liquid draining from the soap supporting recessed area drains directly on the scrubbing surface of the accessory and is thereby retained. Thereby, any liquid soap draining from the shelf or caddy does not directly drip onto an underlying wall or surface area of the tub or enclosure but is retained in a bathing accessory.

It is the primary object of the present invention to provide a shelf or caddy for supporting soaps, shampoo and other containers as well as bathing accessories, including those extended from a string or handle, wherein the shelf or caddy provides a tapered draining recess area for supporting a bar of soap such that any liquid draining therefrom drains outwardly through a tapered slit or slot which supports a bathing element, such as a scrubby, in such a manner that the liquid is trapped by the bathing accessory and does not directly drip onto surfaces of the tub or shower enclosure.

It is yet another object of the present invention to provide a shelf or caddy which may be used on a tiled wall of a shower or tub enclosure and which is notched at its outer inner edges so as to facilitate the placement of the caddy in overlying relationship with respect to adjacent tiles when installed, such that a finished appearance is achieved without having to chisel or cut away underlying tiles adjacent the outermost ends of the shelf or caddy.

It is yet another object of the invention to provide a generally "L" shaped shelf which can be utilized in a tub or shower enclosure and which may be prefabricated so as to be reversible by providing like elements on both upper and lower surfaces thereby allowing the shelf to be placed either in a left hand relationship or a right hand relationship with a tub or shower enclosure depending upon requirements.

In some embodiments, the recessed soap retaining areas are provided on both the upper and lower surfaces of the shelf or caddy so as to be in overlying relationship with respect to one another such that the shelf can be inverted so as to be used in either left hand or right hand corners of a tub or shower enclosure.

It is a further object of the invention to provide a shelf for use with tub and shower enclosures which may be installed in such a manner that it can be recessed within a tiled wall so as to limit the protrusion of the shelf from a wall and to reduce possible interference to a user of a tub or shower enclosure.

BRIEF DESCRIPTION OF THE DRAWINGS

A better understanding of the invention will be had with respect to the accompanying drawings wherein.

DESCRIPTION OF THE PREFERRED EMBODIMENT

Figure 1:
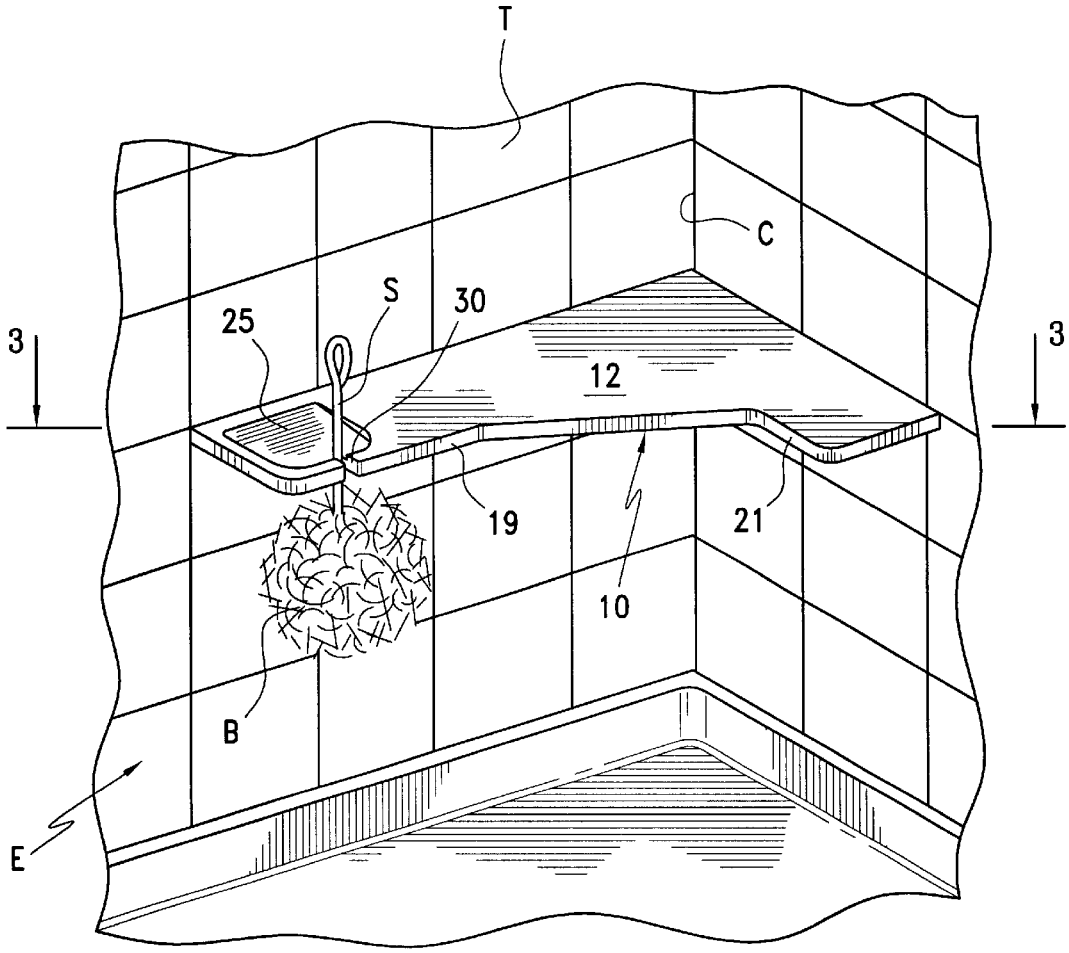
FIG. 1 is a perspective illustrational view of a shelf or article support caddy in accordance with the invention showing a scrubby suspended from the shelf which has been installed within a tiled wall.

With continued reference to the drawing figures, the shelf or article support caddy 10 of the present invention is illustrated in FIG. 1 as being mounted in a corner "C" of a bath tub or shower enclosure "E" such that the shelf extends outwardly from the corner along two walls of the enclosure. As shown, the shelf 10 is designed to be inset within tiles "T" lining the walls of the enclosure "E" such that a very finished appearance is created when the shelf is installed.

The shelf includes a generally "L" shaped body 11 having an upper surface 12 and lower surface 13. The shelf includes a first extended section 14 and a second extended section 15 which, in the preferred embodiment shown, is somewhat shorter than the extended section 14.

The extended section 14 extends from a corner 16 such as to define an inner edge 18 and an outer edge 19. The section 15 extends from the corner 16 and defines an inner edge 20 and an outer edge 21. The outermost portion of each of the edges 18 and 20 are notched, as shown at 22 and 23, respectively. The notches are provided so that it is not necessary to cut and fit an adjacent wall tile around the shelf but allows the end portions of the shelf to be positioned in front of a finished tile, thereby facilitating the manner in which the shelf is installed and also providing a more finished appearance when the shelf is installed. By way of example, each of the notches is approximately ¼ inch in depth from the inner edge of the shelf and may be approximately ¾ to 1 inch in length along the inner edges. To further facilitate the tapering outer edge of most conventional tiles, the innermost edge, 22' and 23', of each of the notches 22 and 23, tapers toward the corner 16 of the shelf. Therefore, when the shelf is installed, the tapered side edge of a conventional tile will completely fill a notch in a complimentary manner, as is shown in cross-section in FIG. 3.

Figure 2:
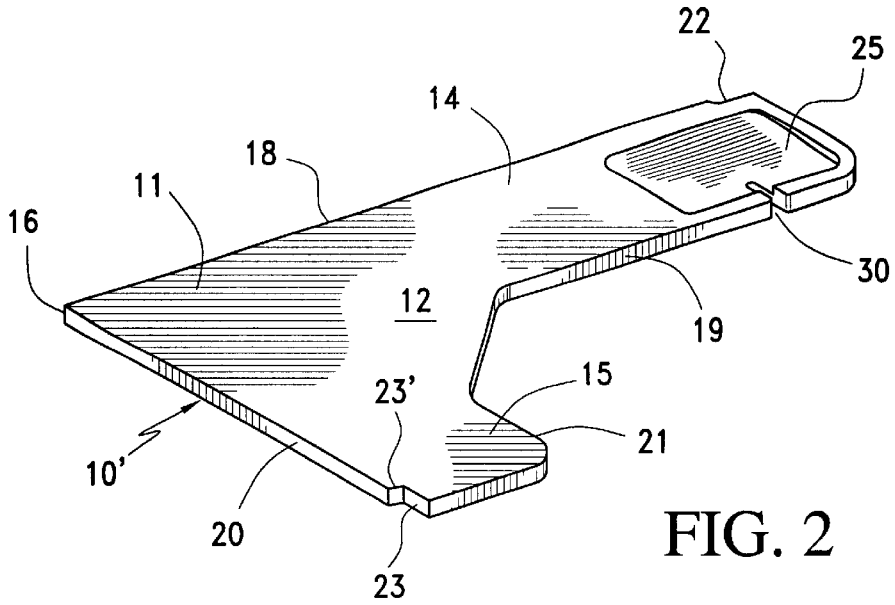
FIG. 2 is a perspective view of a second embodiment of the shelf shown in FIG. 1.

The shelf 10 is preferably formed from an integral piece of tile material or may be formed from a synthetic plastic or other material such as Corian™ or a natural granite material. A typical shelf may be 12 to 16 inches along one inner edge and between 6 to 12 inches on the other inner edge. Also, the shelf may be made to fit opposite corners of an enclosure as shown at 10 in FIG. 1 and at 10' in FIG. 2.

The shelf also includes at least one soap supporting recessed area or tray 25. The recessed area is shown in the drawing figures as being provided on an outer portion of section 14, however, the recessed area 25 can be provided at substantially any area of the shelf adjacent to the front edges 19 and 21.

Figure 3:
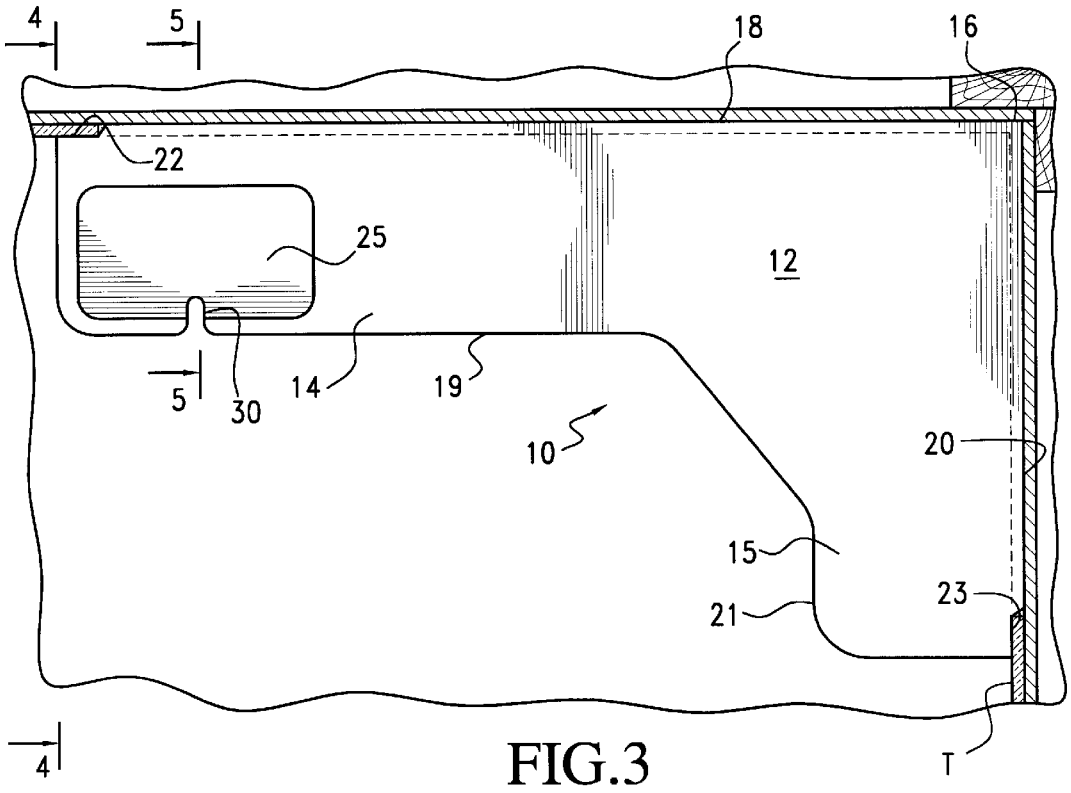
FIG. 3 is a top plan view taken generally along line 3—3 of FIG. 1.
Figure 4:
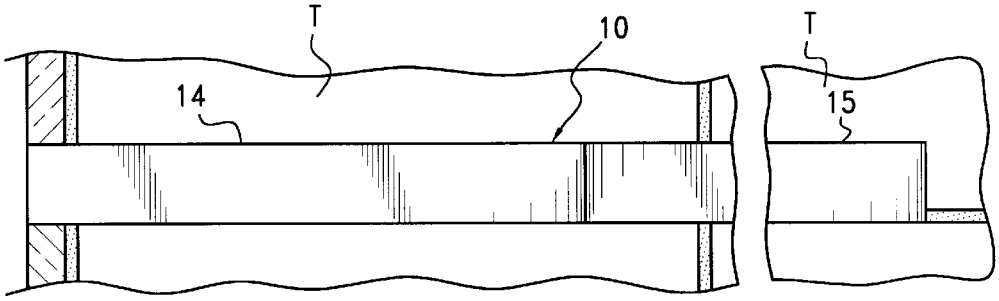
FIG. 4 is an enlarged partial cross-sectional view taken along line 4—4 of FIG. 3.
Figure 5:
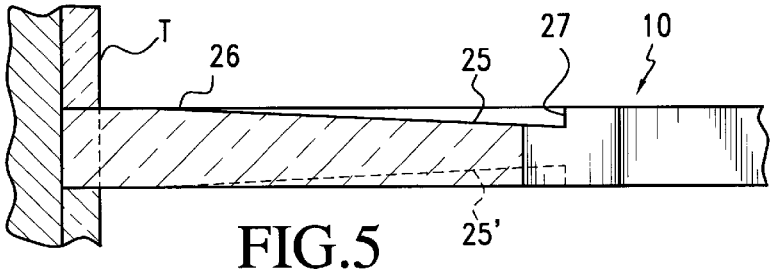
FIG. 5 is a cross-sectional view of an alternate embodiment of the present invention showing the soap tray or recessed area of the shelf or caddy being provided in both the upper and lower surfaces of the shelf thereby allowing the shelf to be used in different corners of a tub or tile enclosure.

The details of the recessed soap supporting tray area 25 are shown in FIGS. 3 and 5. As shown, the recessed area 25 tapers from a rear edge 26 which is flush with the upper surface 12 of the shelf to a forward edge 27 spaced inwardly from the outer edge 19 of the shelf so that liquid will drain toward the forward edge 27.

In order to drain soapy liquid from the tray 25, a tapered slit or slot 30 is provided through the front edge 19 and into the tray area 25 so that any liquid flowing toward the forward edge 27 of the tray will drain through the slot 30. The slot is tapered inwardly from the front edge to the rear portion, as shown in the drawings figures, in order to provide opposing friction gripping or clamping surfaces for a string or handle "S" associated with a shower or tub cleaning accessory, such as a scrubby "B" shown in FIG. 1. In this manner, by inserting the string "S" of the scrubby within the slot 30, the scrubby will be frictionally retained by the opposing walls defining the slot in a position directly beneath the tray 25. Any soapy liquid draining through the slot will drain along the string or handle "S" directly into the scrubby which is made of absorbent material. The absorbent material will thus capture any liquid soap preventing it dripping directly to the floor of the shower or tub enclosure or the sidewalls. In this manner, the structure of the shelf of the invention not only allows for drainage of soapy liquid from the surface of the shelf, it permits such drainage in a manner which facilitates trapping of the liquid soap before it impacts on the walls or floors of the shower or tub enclosure "E".

In order to allow the shelf or caddy 10 of the invention to be used in either right or left hand corners of the tub or shower enclosure, in some embodiments 10", see FIG. 5, a second tapered drainage tray or recessed area 25', identical to that described above, is provided in underlying relationship to the tray area 25. In use, regardless of which side of the tray is placed in an upper position, the soap retaining and drainage trays 25 and 25' will function identically.

In use, the shelf is installed within a tile or masonry wall as shown in FIG. 3 such that the inner edges 18 and 20 are inset with respect to the tiles "T" forming the wall surfaces. The end notches 22 and 23 permit the adjacent finished tile to be inserted in underlying relationship with respect to the outer end portions of each of the sections 14 and 15, also as shown in FIG. 3, thereby forming a very finished appearance for the shelf 10 when installed.

Utilizing the shelf which includes opposing upper and lower soap retaining drainage trays 25 and 25', the shelf may be installed in either left or right hand corners of a shower depending upon requirements.

The shelf not only functions to prevent liquid soap spillage as previously described, but also retains the soap for future use.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A soap and accessory support caddy for a tub or shower enclosure including a body having an inner edge, an upper surface and a lower surface, at least one recessed soap supporting tray integrally formed within at least one of said upper and lower surfaces of said body and being spaced inwardly from an outer edge of said body, said tray tapering inwardly from at least one of said upper or lower surfaces into said body from adjacent a rear portion thereof to a forward portion thereof spaced adjacent to said outer edge of said body, a slot formed inwardly from said outer edge of said body and communicating into said tray, said slot being tapering inwardly from said outer edge into said tray so as to form opposing friction clamping surfaces whereby an article may be clamped within said slot so as to direct liquid from the tray.

2. The soap and accessory supporting caddy of claim 1 including at least first and second recessed soap supporting trays formed in each of said upper and lower surfaces of said body.

3. The soap and accessory supporting caddy of claim 2 in which said first and second trays are provided in opposing relationship with respect to one another.

4. The soap and accessory supporting caddy of claim 3, wherein said body includes first and second inner edges extending outwardly from a corner, and a notch formed in outer portions of each of said first and second inner edges of a size to permit a conventional tile to be seated therein.

5. The soap and accessory supporting caddy of claim 4 in which said body includes first and second sections which are oriented in generally perpendicular relationship with respect to one another.

6. The soap and accessory supporting caddy of claim 5 in which said first section extends outwardly from said corner at a greater distance than said second section.

7. The soap and accessory supporting caddy of claim 2, wherein said body includes first and second inner edges extending outwardly from a corner, and a notch formed in outer portions of each of said first and second inner edges of a size to permit a conventional tile to be seated therein.

8. The soap and accessory supporting caddy of claim 7 in which said body includes first and second sections which are oriented in generally perpendicular relationship with respect to one another.

9. The soap and accessory supporting caddy of claim 8 in which said first section extends outwardly from said corner at a greater distance than said second section.

10. The soap and accessory supporting caddy of claim 1, wherein said body includes first and second inner edges extending outwardly from a corner, and a notch formed in outer portions of each of said first and second inner edges of a size to permit a conventional tile to be seated therein.

11. The soap and accessory supporting caddy of claim 10 in which said body includes first and second sections which are oriented in generally perpendicular relationship with respect to one another.

12. The soap and accessory supporting caddy of claim 11 in which said first section extends outwardly from said corner at a greater distance than said second section.

13. The soap and accessory supporting caddy of claim 1 in which said body includes first and second sections which are oriented in generally perpendicular relationship with respect to one another.

14. The soap and accessory supporting caddy of claim 13 in which said first section extends outwardly from a corner at a greater distance than said second section.

* * * * *